US007348717B2

(12) United States Patent
Wei et al.

(10) Patent No.: US 7,348,717 B2
(45) Date of Patent: Mar. 25, 2008

(54) TRIODE TYPE FIELD EMISSION DISPLAY WITH HIGH RESOLUTION

(75) Inventors: Yang Wei, Beijing (CN); Shou-Shan Fan, Beijing (CN)

(73) Assignees: Tsinghua University, Bejing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 182 days.

(21) Appl. No.: 11/092,494

(22) Filed: Mar. 29, 2005

(65) Prior Publication Data

US 2005/0236961 A1 Oct. 27, 2005

(30) Foreign Application Priority Data

Apr. 23, 2004 (CN) ..... 2004 1 0027043

(51) Int. Cl.
*H01J 1/62* (2006.01)

(52) U.S. Cl. ..... 313/309; 313/495; 313/310

(58) Field of Classification Search ..... 313/309, 313/336, 351, 495–497, 310
See application file for complete search history.

(56) References Cited

U.S. PATENT DOCUMENTS 5,793,154 A * 8/1998 Itoh et al. ..... 313/308
5,818,166 A * 10/1998 Karpov et al. ..... 313/495
5,828,162 A * 10/1998 Danroc et al. ..... 313/309
5,973,444 A * 10/1999 Xu et al. ..... 313/309
6,437,503 B1 8/2002 Konuma
6,445,124 B1 9/2002 Asai et al.
6,486,609 B1 11/2002 Shiratori et al.
6,690,116 B2 2/2004 Song et al.
6,958,499 B2 * 10/2005 Hwang et al. ..... 257/245
2003/0184203 A1 10/2003 Inoue et al.

FOREIGN PATENT DOCUMENTS

EP 1408525 A1 4/2004
JP 2003-242914 8/2003

* cited by examiner

*Primary Examiner*—Joseph Williams
(74) *Attorney, Agent, or Firm*—Jeffrey T. Knapp

(57) ABSTRACT

A triode type field emission display in accordance with the invention includes: a cathode electrode (12) formed on an insulation substrate (10); an insulation layer (13) formed on the cathode electrode; a gate electrode (14) formed on the insulation layer; a number of emitters (16); and an anode electrode (18) with a phosphor layer (19) positioned over the gate electrode. The emitters are distributed on portions of the cathode electrode at two sides of the insulation layer, and a height of the emitters is less than a thickness of the insulation layer. The emitters are capable of emitting electrons from tips thereof, and the emitted electrons are focused on the phosphor layer by an electric field generated by the gate electrode.

20 Claims, 3 Drawing Sheets

TRIODE TYPE FIELD EMISSION DISPLAY WITH HIGH RESOLUTION

BACKGROUND OF THE INVENTION

1. Field of the Invention

The present invention relates to a field emission device and more particularly to a high-resolution field emission display having a three-electrode structure of a cathode, an anode and a gate electrode.

2. Prior Art

Field emission displays (FEDs) are new, rapidly developing flat panel display technologies. Compared to conventional technologies, e.g., cathode-ray tube (CRT) and liquid crystal display (LCD) technologies, FEDs are superior in having a wider viewing angle, low energy consumption, a smaller size and a higher quality display. In particular, carbon nanotube-based FEDs (CNTFEDs) have attracted much attention in recent years.

Carbon nanotube-based FEDs employ carbon nanotubes (CNTs) as electron emitters. Carbon nanotubes are very small tube-shaped structures essentially having a composition of a graphite sheet rolled into a tube. Carbon nanotubes produced by arc discharge between graphite rods were first discovered and reported in an article by Sumio Iijima entitled "Helical Microtubules of Graphitic Carbon" (Nature, Vol. 354, Nov. 7, 1991, pp. 56-58). Carbon nanotubes can have extremely high electrical conductivity, very small diameters (much less than 100 nanometers), large aspect ratios (i.e. length/diameter ratios) (greater than 1000), and a tip-surface area near the theoretical limit (the smaller the tip-surface area, the more concentrated the electric field, and the greater the field enhancement factor). Thus carbon nanotubes can transmit an extremely high electrical current, and have a very low turn-on electric field (approximately 2 volts/micron) for emitting electrons. In summary, carbon nanotubes are one of the most favorable candidates for electrons emitters for electron emission devices, and can play an important role in field emission display applications. With the development of various different manufacturing technologies for carbon nanotubes, the research of carbon nanotube-based FEDs has yielded promising results.

Generally, FEDs can be roughly classified into diode type structures and triode type structures. Diode type structures have only two electrodes, a cathode electrode and an anode electrode only. Diode type structures are unsuitable for applications requiring high resolution displays, because the diode type structures require high voltages, produce relatively non-uniform electron emissions, and require relatively costly driving circuits. Triode type structures were developed from diode type structures by adding a gate electrode for controlling electron emission. Triode type structures can emit electrons at relatively lower voltages.

FIG. 7 is a cross sectional view illustrating one picture element in a conventional triode type FED. Here, a picture element means a minimum unit of an image displayed by the FED. In a typical color FED, the color picture is obtained by a display system using three optical primary colors, i.e., R(red), G(green) and B(blue). Each one of the colors, e.g. R(red), is comprised in a respective single picture element. As an example of a conventional FED, a structure is explained below, in which electrons are emitted to excite a red fluorescent picture element to emit light.

As shown in FIG. 7, an insulation film 102 (e.g., an $SiO_2$ film 1 micron thick) is deposited on a substrate 101 by sputtering, a gate electrode 103 (e.g., an aluminum film 200 nanometers thick) is deposited on the insulation film 102, and a tubular gate hole 104 is formed penetrating the gate electrode 103 and insulation film 102. An emitter 105 is formed with cathode material deposited on the substrate 101 at a bottom of the gate hole 104. An anode electrode 106 is disposed about 5 millimeters above the substrate 101. Fluorescent material 107 with red fluorescent property is coated on part of the anode electrode 106 located just over the gate hole 104. In use, different voltages are applied to the emitter 105, the anode electrode 106 and the gate electrode 103. For example, about 5.1 kilovolts is applied to the anode electrode 106 and the fluorescent part, about 7.0 volts is applied to the emitter 105 made of cathode material, and about 100 volts is applied to the gate electrode 103. Thereby, equipotential surfaces (not labeled) are formed. Here, a distance between the anode electrode 106 and the gate electrode 103 is about 5 millimeters, and the voltage is about 5000 volts. Thus, an electric field between the both electrodes 106 and 103 is given by:

$$5000/5[\text{V/mm}]=1[\text{kV/mm}]$$

On the other hand, a distance between the gate electrode 103 and the emitter 105 is 1 micron ($10^{-3}$ millimeters), and the voltage is 100 volts. So, an electric field between the gate electrode 103 and the emitter 105 is given by:

$$100/10^{-3}[\text{V/mm}]=100[\text{kV/mm}]$$

Under this configuration, electrons can be extracted from the emitter 105 by the strong electric field of 100 kV/mm. The electrons are then accelerated toward the anode electrode 106 by the normal electric field of 1 kV/mm. However, electrons such as the electrons 110 and 111 diverge in directions getting away from a central axis of the picture element while they travel toward the anode electrode 106. Only a portion of electrons such as the electrons 109 correctly reach the fluorescent material 107 of the target picture element. In FED, the picture elements are generally arranged very closely together. Therefore the divergent elections are liable to reach the fluorescent material 107 of a neighboring picture element. Generally, the fluorescent material 107 of the neighboring picture element is either green or blue, such that a different color is generated. Also, if electrons arrive at fluorescent material 107 of a neighboring red-color's picture element, then a failure in space revolution occurs.

U.S. Pat. No. 6,445,124, granted to Hironori Asai et al., discloses a field emission device structured to resolve the above-described problems. Referring to FIG. 8, the field emission device includes a cathode layer 203 made of a conductive thin film with a thickness of about 0.01 to 0.9 microns, which is formed by deposition or sputtering on an insulation substrate 211. An insulation layer 202 made of $SiO_2$ is formed on the cathode layer 203. A gate electrode 201 is formed on the insulation layer 202. A circular hole (not labeled) with a diameter of 40 to 100 nanometers penetrating the gate electrode 201 and the insulation layer 202 is formed by a reactive ion etching (RIE) process. An electron emissive layer 207 is formed on the cathode layer 203 inside the hole. A ratio of L/S should be equal to or over 1, where S represents an aperture diameter of the hole, and L represents a typical shortest passing distance of electrons emitted from the emissive layer 207 to the gate electrode 201. When the ratio of L/S is equal to or over 1, paths of electrons emitted from the emissive layer 207 are controlled to become narrow. Only electrons that move in a direction approximately vertical to the electron emissive layer 207 can pass through the hole and reach the anode, such that the electrons reach the correct phosphor unit.

However, the efficiency of electron emission is low, because a portion of electrons emitted from the emissive layer 207 are absorbed by the gate electrode 201 or blocked by the insulation layer 202 when they travel in the hole in directions other than the direction perpendicular to the cathode layer 203. The greater the L/S, the more electrons are lost, and the lower the efficiency of electron emission. In addition, a high L/S ratio means a higher voltage applied to the gate electrode is required, in order to generate an electric field strong enough to extract electrons from the emissive layer 207.

SUMMARY OF THE INVENTION

Accordingly, an object of the present invention is to provide a triode type field emission display which has an improved efficiency of electron emission, by emitting electrons at a relative low voltage, and by focusing the emitted electrons to a desired picture element effectively.

Another object of the present invention is to provide a triode type field emission display which has high resolution and good display quality.

In order to achieve the objects set above, a triode type field emission display in accordance with the present invention comprises: a cathode electrode formed on a substrate; an insulation layer formed on a first part of the cathode electrode; a gate electrode formed on the insulation layer; an anode electrode having a phosphor layer positioned over the gate electrode; and a plurality of emitters corresponding to a picture element of the field emission display distributed on a second part of the cathode electrode adjacent two sides of the insulation layer. A height of the emitters is less than the thickness of the insulation layer.

The emitters are selected from the group consisting of carbon nanotubes, carbon fibers, graphite carbon, diamond carbon and metallic material with tips on a top. The emitters preferably extend vertically from the cathode electrode.

Electrons are emitted from tips of the emitters and focused on the phosphor layer by an electric field generated by the gate electrode when a voltage applied thereto.

The cathode electrode is made of a conductive material, preferably an ITO (Indium-Tin Oxide) thin film. Further, the cathode electrode is strip-shaped.

Further, the insulation layer only partly covers the cathode electrode.

Other objects, advantages and novel features of the present invention will become more apparent from the following detailed description when taken in conjunction with the accompanying drawings, in which:

DETAILED DESCRIPTION OF THE INVENTION

Reference will now be made to the drawings to describe a preferred embodiment of the present invention in detail.

Figure 1:
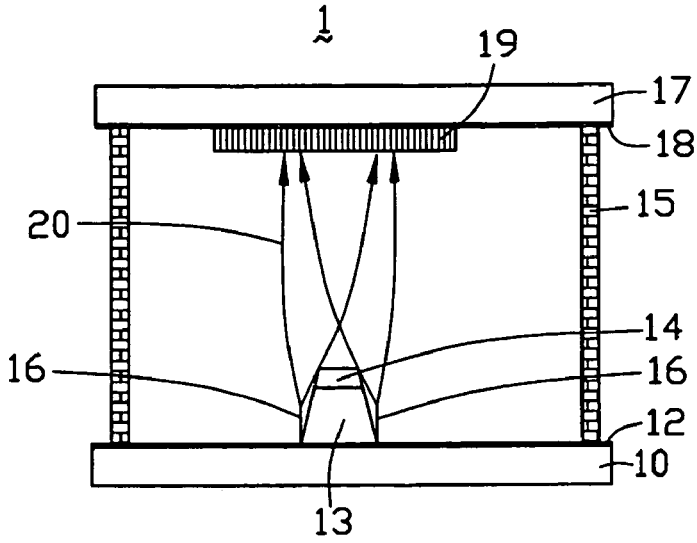
FIG. 1 is a schematic, side elevation view of one picture element of a field emission display according to a preferred embodiment of the present invention.

Referring initially to FIG. 1, one picture element or display pixel unit of a carbon nanotube-based field emission display 1 in accordance with a preferred embodiment of the present invention comprises: a cathode electrode 12 which is formed on an insulation substrate 10; an insulation layer 13 made of an insulative material disposed on the cathode electrode 12 and covering only a part of the cathode electrode 12; a gate electrode 14 made of a metallic material (preferred metal with excellent electrical conductivity) formed on a top of the insulation layer 13; a plurality of carbon nanotubes 16 (only two are shown in the FIG. 1) functioning as electron emitters for emitting electrons formed on portions of the cathode electrode 12 adjacent to two sides of the insulation layer 13; an anode electrode 18 made of an indium-tin-oxide (ITO) thin film formed on a surface of a transparent glass substrate 17 facing the gate electrode 14; and a phosphor layer 19 formed on a surface of the anode electrode 18, and which can emit light when bombarded by electrons 20. The field emission display 1 is vacuum-sealed. The anode electrode 18 on the glass substrate 17 is supported by insulative spacers 15, so that the anode electrode 18 is spaced apart from the gate electrode 14. An inner vacuum chamber (not labeled) is thereby defined between the anode electrode 18 and the cathode electrode 12.

The insulation substrate 10 can be made of a flat sheet of glass or other insulative material. The cathode electrode 12 is made of a conductive material, e.g. an indium-tin-oxide (ITO) thin film or a metallic thin film. The cathode electrode 12 is shaped into a long bar or strip. It is to be understood that for the entire carbon nanotube-based field emission display 1, a plurality of the cathode electrodes 12 is arranged parallel to each other on the insulation substrate 10.

Preferably, the carbon nanotubes stand vertically on the cathode electrode 12. A height of the carbon nanotubes is lower than a thickness of the insulation layer 13, so that tops of the carbon nanotubes are a distance below a bottom of the gate electrode 14. This avoids short-circuiting between the cathode electrode 12 and the gate electrode 14 via the carbon nanotubes 16. However, the height of the carbon nanotubes 16 is not subjected to any other limitations, such as a limitation of L/S>=1 in U.S. Pat. No. 6,445,124. In other words, the carbon nanotubes 16 can almost reach but not quite reach the gate electrode 14. Preferably, in order to lower a turn-on voltage, the tops of the carbon nanotubes 16 should be as close to the gate electrode 14 as possible without causing short-circuiting.

Preferably, the insulation layer 13 is wedge-shaped, wherein a width of a bottom thereof is greatest and a width of a top thereof is smallest. The insulation layer 13 is tapering from the greatest width to the smallest width.

In use, different voltages are applied to the anode electrode 18, gate electrode 14 and the cathode electrode 12; for example, 1000 volts to several thousands volts for the anode electrode 18, several tens of volts to a hundred volts for the gate electrode 14, and a zero or grounded voltage for the cathode electrode 12. Electrons 20 are extracted from the carbon nanotubes 16 by a strong electric field generated by the gate electrode 14, and accelerated by an electric field generated by the anode electrode 18 toward the phosphor layer 19. Thereby, visible light of desired color emits from the phosphor layer 19 under bombardment by the electrons.

In the present invention, the structure of the gate electrode 14 being located at a position corresponding to a center of the phosphor layer 19 and the carbon nanotubes 16 functioning as electron emitters positioned adjacent two sides of the gate electrode 14 can be called a center-gated triode FED. This structure is an important innovation of the present invention. In this center-gated triode FED, the gate electrode 14 functions not only to extract electrons from the carbon nanotubes 16, but also to focus the extracted electrons on a center area of the phosphor layer 19. That is, the electrons extracted from the carbon nanotubes 16 are concentrated and directed to a narrow point at the phosphor layer 19 by the electric field generated by the gate electrode 14. Hence, electron bombardment of the phosphor layer 19 can be precisely controlled, and a high resolution display can be realized.

Detailed structures of the field emission display 1 of the present invention, including a mechanism of focusing electrons and other features, will be described in detail below.

Figure 2:
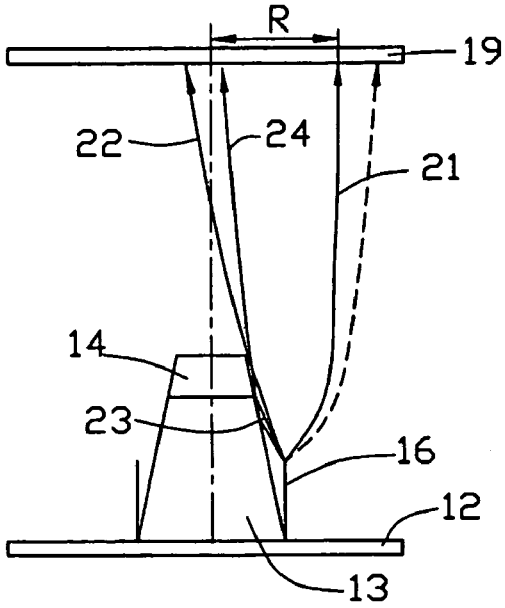
FIG. 2 is an enlarged view of part of FIG. 1, showing paths of electrons emitted from an emitter of the field emission display.

Referring to FIG. 2, paths of electrons emitted from a carbon nanotube 16 are shown. It is noted that there are in fact many carbon nanotubes 16 distributed at the two sides of the gate electrode 13. However, only two carbon nanotubes 16 are shown in FIG. 2, and only electrons emitted from the carbon nanotube 16 at the right side of the gate electrode 13 are illustrated in FIG. 2. Electrons emitted from other carbon nanotubes 16 at both sides of the gate electrode 13 are subjected to the same electric field and move in a similar way.

Generally, the electrons emitted from the carbon nanotube 16 can be classified into four kinds: external electrons 21, internal electrons 22, obstructed electrons 23, and reflected electrons 24. The external electrons 21 initially move in directions generally away from the central gate electrode 14, but are subjected to the electric field force and attracted back somewhat toward the central gate electrode 14 during their travel. The external electrons 21 finally arrive at a position of the phosphor layer 19 that is a distance of R away from a center point of the phosphor layer 19. The distance R is less than the corresponding distance in a conventional FED not having the center-gated structure of the present invention (the path of a corresponding electron emitted in the conventional FED is shown as a dashed line in FIG. 2). The internal electrons 22 initially move in directions generally slightly toward to the central gate electrode 14, and are subjected to the electric field force and attracted closer toward the gate electrode 14 without contacting the gate electrode 14. The internal electrons 22 finally arrive at a position of the phosphor layer 19 at a side of the center point opposite to the carbon nanotube 16. A distance from this position to the center point is less than the distance R. The obstructed electrons 23 initially move in directions generally toward to the central gate electrode 14, and are subjected to the electric field force and attracted closer toward the gate electrode 14. The obstructed electrons 23 contact the gate electrode 14, and are blocked and absorbed by the gate electrode 14. That is, the obstructed electrons 23 do not reach the phosphor layer 19. The reflected electrons 24 initially move in directions generally toward the insulation layer 13, and are subjected to the electric field force and attracted closer toward the gate electrode 14. The reflected electrons 24 contact the insulation layer 13, and are reflected by the insulation layer 13 toward the phosphor layer 19. The reflected electrons 24 finally arrive at a position of the phosphor layer 19 in the vicinity of the center point.

Thus it can be seen that the greatest diameter of the area on the phosphor layer 19 being bombarded by electrons is 2R, which is less than the corresponding area of the conventional FED not having the center-gated structure of the present invention. The novel configuration of the present invention whereby the gate electrode 14 is located in a center of the carbon nanotubes 16 provides excellent electron focusing capability. A majority of electrons emitted from the carbon nanotubes 16 are concentrated in the vicinity of the center point of the phosphor layer 19 corresponding to the gate electrode 14.

It is noted that the electron focusing capability can be enhanced by increasing the voltage applied to the gate electrode 14 and/or reducing the voltage applied for the anode electrode 18, or by enlarging a distance between the gate electrode 14 and the anode electrode 18. In addition, the gate electrode 14 can capture more obstructed electrons 23 if a thickness of the gate electrode 14 is increased.

Figure 3:
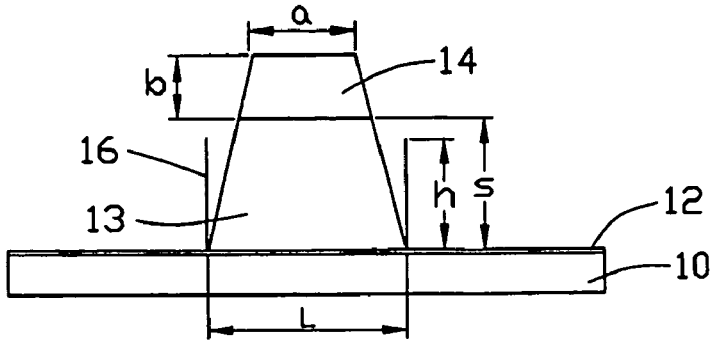
FIG. 3 is essentially an enlarged view of the emitter of FIG. 2, showing a cathode electrode and a gate electrode thereof and dimensions thereof.

Referring to FIG. 3, the gate electrode 14 and the carbon nanotubes 16 distributed at two sides thereof constitute an electron emission structure. Here, one electron emission structure corresponds to one picture element, which is the smallest unit contributing to a picture display. The picture element is bombarded by electrons emitted from the carbon nanotubes 16 of the corresponding electron emission structure, and emits light. It is to be understood that a multiplicity of the electron emission structures can be aggregated to obtain a large sized display.

The electron emission structure includes the insulation substrate 10, the cathode electrode 12, the insulation layer 13, the gate electrode 14, and the carbon nanotubes 16. The insulation layer 13 is wedged-shaped, and the gate electrode 14 is also wedged-shaped. The carbon nanotubes 16 are distributed at two sides of the insulation layer 13. As an example, the insulation layer 13 has a bottom width L of 50 microns, and a height 's' of 40 microns. The gate electrode 14 has a height 'b' of 10 microns, and a smallest width 'a' of 30 microns at its top. A height 'h' of the carbon nanotubes 16 is 30 microns. A distance between the cathode electrode 12 and the anode electrode 18 is 1.1 millimeters. The voltages applied for the cathode electrode 12, the gate electrode 14 and the anode electrode 18 are 0 volts, 150 volts, and 2000 volts respectively. Simulation results of the above configuration yield a displayed color dot having a diameter of approximately 0.4 millimeters.

It is noted that the present invention can be optimized to meet different desired resolution displays by adjusting any one or more of the following parameters:

a) the voltages for the anode electrode 18, the gate electrode 14, and the cathode electrode 12;
b) the distance between the cathode electrode 12 and the anode electrode;
c) the thickness of the gate electrode 14;
d) the distance between the tops of the carbon nanotubes 16 and the gate electrode 14; and
e) the bottom width L of the insulation layer 13.

In the above embodiment, the carbon nanotubes 16 can be made by a chemical vapor deposition method.

Figure 4:
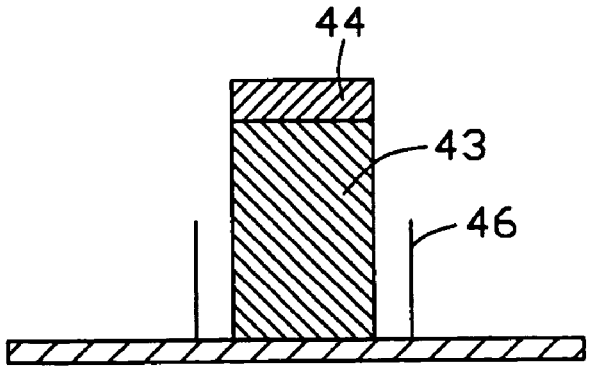
FIG. 4 is essentially a schematic, side cross-sectional view of an alternative emitter of the field emission display according to the present invention.
Figure 5:
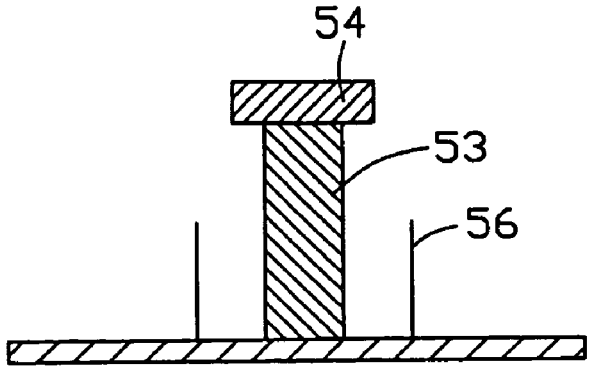
FIG. 5 is essentially a schematic, side cross-sectional view of a further alternative emitter of the field emission display according to the present invention.
Figure 6:
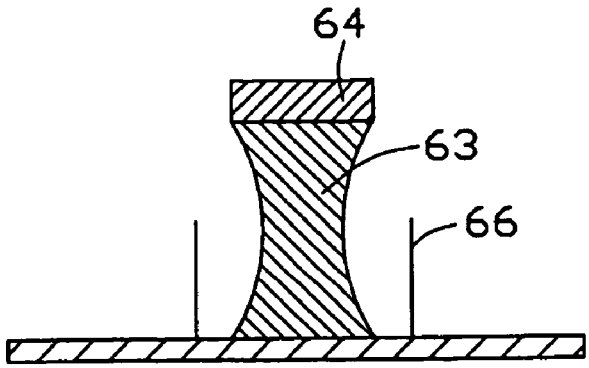
FIG. 6 is a essentially schematic, side cross-sectional view of a still further alternative emitter of the field emission display according to the present invention.
Figure 7:
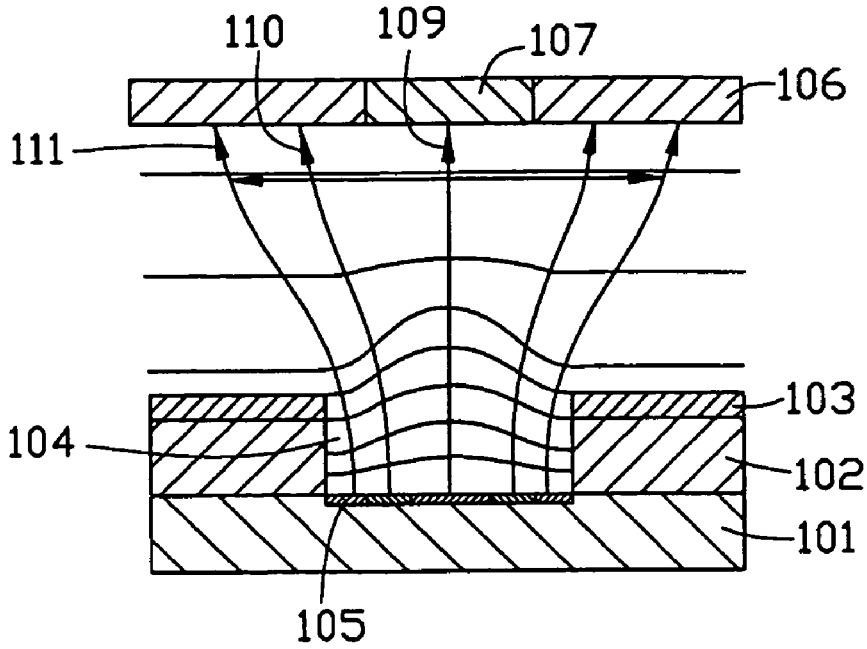
FIG. 7 (PRIOR ART)
FIG. 7 is a cross-sectional view of a picture element of a conventional field emission display.
Figure 8:
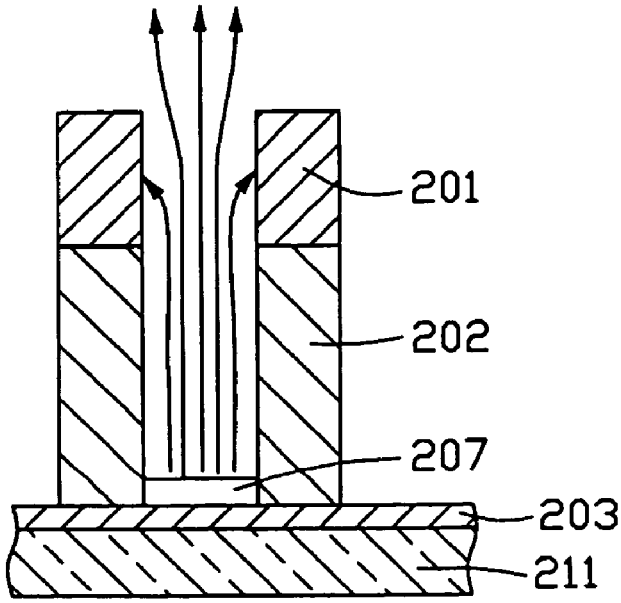
FIG. 8 (PRIOR ART)
FIG. 8 is a cross-sectional view of part of another conventional field emission display.

Referring to FIGS. 4 to 6, insulation layers having shapes other than wedge shapes can be employed in the present invention. In FIG. 4, an insulation layer 43 with a rectangular cross-section is shown. A gate electrode 44 having a same width as that of the insulation layer 43 is formed on the insulation layer 43. Carbon naotubes 46 stand at two sides of the insulation layer 43 below the gate electrode 44. In FIG. 5, an insulation layer 53 with a rectangular cross-section is shown. A gate electrode 54 having a width greater than that of the insulation layer 53 is formed on the insulation layer 53. Carbon nanotubes 56 stand at two sides of the insulation layer 53 below the gate electrode 54. In FIG. 6, a double-concave insulation layer 63 is shown. A gate electrode 64 is formed on a top of the insulation layer 63. A width of the gate electrode 64 is the same a width of the top of the insulation layer 63. Carbon nanotubes 66 stand at two sides of the insulation layer 63 below the gate electrode 64.

It is also noted that even though the electron emitters of the present invention are preferably carbon nanotubes, the invention is not limited to carbon nanotubes. Other structures and materials having suitable field emission tips can be employed; for example, carbon fibers, graphite carbon, diamond carbon, or metallic emitters.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A triode type field emission display comprising:

a plurality of display units, each of the display units comprising:

a cathode electrode formed on a substrate;

an insulation layer formed on a part of the cathode electrode;

a gate electrode formed on a top surface of the insulation layer;

an anode electrode formed on a transparent substrate, the anode electrode positioned opposite to the cathode electrode;

a phosphor point positioned on the transparent substrate, a center of the phosphor point corresponding to the gate electrode; and a plurality of emitters distributed on the cathode electrode, the emitters positioned at two opposite sides of the gate electrode, wherein the emitters are capable of emitting electrons from tips thereof and the emitted electrons are focused on the phosphor point over the gate electrode by an electric field generated by the gate electrode, and a height of the emitters is less than a thickness of the insulation layer.

2. The triode type field emission display as described in claim 1, wherein the cathode electrode is made of a conductive material and is strip-shaped.

3. The triode type field emission display as described in claim 2, wherein the cathode electrode is made of a conductive thin film.

4. The triode type field emission display as described in claim 3, wherein the cathode electrode includes an Indium Tin Oxide thin film.

5. The triode type field emission display as described in claim 1, wherein the emitters are selected from the group consisting of carbon nanotubes, carbon fibers, graphite carbon, diamond carbon and metallic material.

6. The triode type field emission display as described in claim 1, wherein the emitters stand vertically on the cathode electrode.

7. The triode type field emission display as described in claim 1, wherein the insulation layer has a truncated wedge shape, with a width of a bottom of the insulation layer being greater than a width of a top of the insulation layer.

8. The triode type field emission display as described in claim 1, wherein the insulation layer has a rectangular cross-section.

9. The triode type field emission display as described in claim 1, wherein the field emission display is vacuum sealed.

10. A triode type field emission display comprising a plurality of display units, each of the display units comprising:

a cathode electrode;

an insulation layer disposed on and covering only a part of the cathode electrode, with other parts of the cathode electrode adjacent two sides of the insulation layer being exposed;

a gate electrode formed on a top surface of the insulation layer;

an anode electrode with a phosphor point deposited thereon, a center of the phosphor point corresponding to the gate electrode; and a plurality of emitters distributed on the exposed parts of the cathode electrode, the emitters positioned at two opposite sides of the gate electrode, wherein the emitters are capable of emitting electrons from tips thereof and the emitted electrons are focused on the phosphor point over the gate electrode by an electric field generated by the gate electrode when a voltage is applied to the gate electrode, and a height of the emitters is less than a thickness of the insulation layer.

11. The triode type field emission display as described in claim 10, wherein the cathode electrode is made of a conductive material.

12. The triode type field emission display as described in claim 11, wherein the cathode electrode includes an Indium Tin Oxide thin film.

13. The triode type field emission display as described in claim 10, wherein the emitters includes carbon nanotubes.

14. The triode type field emission display as described in claim 10, wherein the insulation layer has a truncated wedge shape, with a wide bottom part at the cathode electrode and a narrow top part at the gate electrode.

15. The triode type field emission display as described in claim 10, further comprising a transparent glass substrate with the anode electrode formed thereon.

16. A field emission display comprising a plurality of display pixel units, each of said plurality of display pixel units comprising:

an anode electrode with a light-emitter layer formed thereon;

a cathode electrode disposed away from said anode electrode a predetermined distance;

a plurality of emitters disposed on said cathode electrode; and a gate electrode disposed below said light-emitter layer, said gate electrode corresponding to a center of said light-emitter layer and being closer to said light-emitter layer than said plurality of emitters, a projective area of said gate electrode on said cathode electrode being substantially surrounded by said plurality of emitters on said cathode electrode, and said emitters being capable of emitting electrons from tips thereof to urge light emission by said light emitter layer when said gate electrode is electrified.

17. The field emission display as described in claim 16, wherein said plurality of emitters include carbon nanotubes.

18. The field emission display as described in claim 16, further comprising a transparent glass substrate to which said anode electrode is attached.

19. The triode type field emission display as described in claim 2, further comprising at least another cathode electrode also formed on the substrate, wherein the at least another cathode electrode is strip-shaped, and the strips of the cathode electrode and the at least another cathode electrode are substantially parallel to each other.

20. The triode type field emission display as described in claim 1, further comprising an insulative spacer, the insulative spacer supporting the anode electrode and separating the anode electrode from the cathode electrode.

* * * * *